US011014700B2

(12) United States Patent
Häring

(10) Patent No.: US 11,014,700 B2
(45) Date of Patent: May 25, 2021

(54) PACKAGING MACHINE WITH COMPENSATION CYLINDER

(71) Applicant: Multivac Sepp Haggenmüller SE & Co. KG, Wolfertschwenden (DE)

(72) Inventor: Rainer Häring, Lauben (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 169 days.

(21) Appl. No.: 16/404,467

(22) Filed: May 6, 2019

(65) Prior Publication Data

US 2019/0344916 A1 Nov. 14, 2019

(30) Foreign Application Priority Data

May 8, 2018 (DE) ..... 10 2018 111 001.4

(51) Int. Cl.
*B65B 65/02* (2006.01)
*B65B 31/02* (2006.01)

(52) U.S. Cl.
CPC ..... *B65B 65/02* (2013.01); *B65B 31/02* (2013.01)

(58) Field of Classification Search
CPC ..... F16C 7/00; F16J 1/14; F16J 1/16; F16J 1/22; F16J 1/24; F16J 1/20; B30B 15/007; B30B 15/068; B65B 31/02; B65B 31/024; B65B 59/04; B65B 65/02
USPC ..... 74/579 R, 586, 593; 92/187; 53/393, 53/559, 510, 511, 512
See application file for complete search history.

(56) References Cited

U.S. PATENT DOCUMENTS 2,405,675 A 8/1946 Southwick, Jr.
4,442,694 A * 4/1984 Fusser ..... B30B 15/068 100/269.12
4,552,524 A * 11/1985 Schmidts ..... B30B 1/323 425/406
4,553,373 A * 11/1985 Viitanen ..... B29C 66/8242 53/441
4,602,596 A * 7/1986 Kessler ..... F16J 1/24 123/48 B
5,155,969 A * 10/1992 Kuethe ..... B65B 31/028 53/329.4
5,226,269 A * 7/1993 Stoltenberg ..... B65B 39/04 53/433
5,307,610 A * 5/1994 Schneider ..... B29C 51/34 425/384

(Continued)

FOREIGN PATENT DOCUMENTS

DE 7327517 U 11/1973
EP 3241763 A1 11/2017
GB 2224462 A 5/1990

*Primary Examiner* — Hemant Desai
*Assistant Examiner* — Christopher Robin Kim
(74) *Attorney, Agent, or Firm* — Brooks Kushman P.C.

(57) ABSTRACT

A packaging machine having at least one working component that is mounted in an adjustable manner relative to a machine frame between a first and a second position, and that incorporates at least one pneumatic unit. A coupling member may be mounted in a tiltable manner relative to an axis, and in one embodiment, the coupling member may connect the pneumatic unit to the working component. The coupling member may be arranged at least in part within a piston of the pneumatic unit and may be mounted in a linearly adjustable manner along the axis.

16 Claims, 4 Drawing Sheets

(56) References Cited

U.S. PATENT DOCUMENTS

| | | | | |
|---|---|---|---|---|
| 5,894,711 | A * | 4/1999 | Davidson | B65B 23/00 53/432 |
| 6,018,932 | A * | 2/2000 | Eberhardt, Jr. | B65B 25/067 53/432 |
| 6,105,341 | A * | 8/2000 | Campbell | B21D 51/32 413/27 |
| 6,637,177 | B1 * | 10/2003 | Trillich | B65B 1/28 53/434 |
| 6,913,497 | B1 * | 7/2005 | Ahlswede | B63H 20/12 440/63 |
| 9,032,695 | B2 * | 5/2015 | Haring | B65B 31/028 53/433 |
| 2002/0152724 | A1 * | 10/2002 | Paul | B65B 31/028 53/432 |
| 2004/0144063 | A1 * | 7/2004 | Countz | B65B 51/146 53/434 |
| 2005/0126129 | A1 * | 6/2005 | Nesci | B29C 66/4312 53/510 |
| 2006/0248860 | A1 * | 11/2006 | Liao | B65B 31/028 53/510 |
| 2009/0260320 | A1 * | 10/2009 | Miller | B65B 31/024 53/94 |
| 2009/0313954 | A1 * | 12/2009 | Aarts | G01M 3/366 53/510 |
| 2012/0285126 | A1 * | 11/2012 | Vaccari | B29C 66/131 53/510 |
| 2016/0160645 | A1 * | 6/2016 | Doyle | F16J 1/22 92/155 |
| 2016/0251102 | A1 | 9/2016 | Landolt et al. | |
| 2016/0332326 | A1 * | 11/2016 | Pope | B30B 15/048 |
| 2016/0341189 | A1 * | 11/2016 | Casellas | F04B 39/0022 |
| 2018/0320732 | A1 * | 11/2018 | Kim | F02B 75/045 |

* cited by examiner

PACKAGING MACHINE WITH COMPENSATION CYLINDER

CROSS-REFERENCE TO RELATED APPLICATIONS

This Application claims priority to German Patent Application No. 10 2018 111 001.4 filed on May 8, 2018 to Rainer Haring, currently pending, the entire disclosure of which is incorporated herein by reference.

BACKGROUND OF THE INVENTION

In many areas of mechanical engineering, complex costly mechanical machined components are replaced by simple sheet metal structures. However, these less expensive sheet metal structures in the untreated state are often not able to ensure the required dimensional or shape and positional tolerances for use in installation assemblies, especially in mobile installation structures. This often leads to the "distortion" of statically overdetermined systems. There is a need in the art to resolve the "distortion" which prevents the less expensive sheet metal structures being utilized.

EP 3 241 763 A1 discloses a chamber belt machine with a sealing device for a sealing operation, where the sealing device comprises a sealing rail that is mounted within the cover of the chamber belt machine and displaceable by way of an inflatable membrane.

With regard to the above-mentioned problem of "distortion" in the use of simple inexpensive sheet metal structures within complex, possibly movable installation assemblies, the invention is based on the object of providing a packaging machine in which a solution to remedy this problem is provided by the way of simple technical measures.

SUMMARY OF THE INVENTION

The invention relates to a packaging machine which comprises at least one working component that is mounted to be adjusted or moved between a first and a second position relative to a machine frame by way of at least one pneumatic unit.

It is the idea of the invention that, disposed at least in part within a piston of the pneumatic unit and mounted to be linearly adjustable along an axis, a coupling member may be attached tiltable manner relative to the axis and connecting the pneumatic unit to the working component. An adjusting motion of the piston may be then transmitted indirectly via the coupling member, which may be tiltably attached to the piston and to the working component, where the piston and the coupling member attached thereto form a unit which acts as a compensation cylinder, whereby it may be possible to compensate the inaccuracies of the installation assembly arising during edging or welding, in particular when the working component may be adjusted during installation or assembly (a compensating function).

Due to the fact that the coupling member is according to the invention at least in part received within the piston of the pneumatic unit, the invention provides a compact design in which angle errors as well as inaccuracies along different spatial directions can be compensated in the assembled state of the installation assembly by way of the compensating cylinder function on the pneumatic unit.

Another major advantage of the pneumatic unit with the compensating function used with the invention is that it does not cause distortion or jamming of the components even with a non-synchronized travel motion of several pneumatic units connected to the working component in a manner according to the invention, because the respective pneumatic units can compensate certain assembly inaccuracies well among each other. This ensures proper operation of the working component, for example, a sealing unit with a sealing rail.

According to one variant, the coupling member may be formed as an extended, possibly multi-part, rigid body, where it may be movably suspended at its respective ends between the pneumatic unit and the working component. The coupling member during operation may be preferably aligned in an equilibrium position in which it may be arranged vertically. If the coupling member may be deflected out of its equilibrium position during operation to achieve the compensating effect described above, it can automatically pivot back to its equilibrium position within one work cycle due to a restoring force acting upon the coupling member.

In the abstract sense, the coupling member can be coupled like a physical pendulum between the piston of the pneumatic unit arranged linearly slidable and the working component moved therewith, whereby it may be possible to compensate the linear lifting motion performed by the piston with a motion component subject to a deflection angle, i.e. in accordance with the deflection of the coupling member out of its equilibrium position, in order to avoid distortion of the mutually coupled components based on this superimposed motion.

The coupling member may be preferably mounted triaxially rotatable relative to the axis within the piston. It may be therefore mounted pivotable in all directions relative to the (piston) axis, so that a maximum compensation function may be given with regard to possibly existing assembly inaccuracies. The connection of the piston to the working component via the movable coupling member allows for sufficient clearance to reliably prevent distortion or jamming between the linearly guided piston and the working component moved therewith, but not rigidly connected to the piston. In addition, the coupling member thus mounted in a manner articulated in all directions can be used advantageously, especially in the case of recurring work processes, in particular to avoid material fatigue phenomena, so that the packaging machine can work flawlessly for a long period of time.

It may be advantageous to have the piston comprise a piston rod that may be at least in part formed to be hollow, within which the coupling member may be attached in an articulated manner. Such a piston together with the coupling member received therein at least in part form a compact compensation cylinder unit and may be at the same time easy to manufacture.

The coupling member at a first end preferably comprises a first joint with which it may be attached in an articulated manner within the piston, and/or at a second end a second joint with which it may be connected to the working component in an articulated manner. As a result, it may be possible to create a mechanical clearance between the pneumatic unit and the working component adjustably mounted thereto, which advantageously provides a compensation function to avoid static distortions between the coupled components, even if there are numerous repetitions of the working process performed by the working component over a longer period of time.

According to one improved variant, it may be provided that the first and the second joint may be each a pivot or a ball joint. These joints form a simple and inexpensive solution and may be structurally excellently suitable for the compensation function between the pneumatic unit and the working component attached thereto.

The coupling member may be preferably mounted tiltable within the piston to the piston by way of a pin mounted perpendicular to the axis. A comparable attachment can also be present between the coupling member and the working component connected thereto. The coupling member may be preferably releasably attached within the piston to perform an exchange and/or conversion function.

A configuration variant provides that the coupling member comprises a connector pin attached thereto in an exchangeable manner in order to obtain a predetermined longitudinal extension of the coupling member. Connector pins of different lengths can there respectively be employed at the coupling member in order to configure the coupling element as such with different lengths for a specific purpose, for example, to be used for different types of packaging machines and/or with different working components. In particular, this allows for a variable sealing adjustment height so that producing different batches of products with different product sizes may be possible using the packaging machine.

One advantageous variant provides that a lifting motion can be performed at the working component by way of several pneumatic units connected thereto and/or that the working component may be mounted slidable along a guide. The drive advantageously provided in the region of pneumatic unit(s) with a mechanical clearance to compensate for assembly inaccuracies can then be sensibly compensated by use of the guide to precisely transfer the pneumatic drive motion onto the working component such that they may be transferred with positional accuracy from the first to the second position in which a work process performed using the working component, such as a sealing and/or cutting process, takes place. From this perspective, the pneumatic drive, provided in accordance with the invention to compensate for positional and assembly inaccuracies, can ensure in interaction with the guide that the working component can be moved accurately into its working position without jamming.

The several pneumatic units may be preferably arranged side by side, in particular in a row, at the packaging machine, so that the respective pneumatic units engage in an offset manner at different locations along the working component, in order to displace the latter during operation between the respective working positions.

Preferably, the packaging machine comprises a sealing station and the working component may be configured as a sealing rail adjustably attached thereto. In particular for use at the sealing station, the pneumatic unit according to the invention with the compensating function may be excellently suited to relocate the sealing rail coupled thereto according to a machine cycle of the packaging machine time and again between the respective positions in a tension-free manner. However, it would also be conceivable to use the pneumatic unit or several of them configured according to the invention for moving a working component movably mounted to a forming station, loading station, gas flushing station and/or cutting station.

It may be advantageous to have the pneumatic unit be arranged on a cover of the sealing station, where the coupling member of the pneumatic unit may be connected to the sealing rail positioned within the cover. Positioning the pneumatic unit on the cover of the sealing station frees space within the cover for providing other work modules. In addition, the pneumatic unit positioned on the cover, i.e. not within the cover, can be excellently supplied with compressed air and may be also better accessible for service and/or cleaning processes.

The packaging machine preferably comprises at least four pneumatic units. They can be particularly effectively actuated for coupled pneumatic operation and can take the working component, such as a longitudinally formed sealing rail coupled to the respective pneumatic units, in a tension-free manner and with a predetermined force and speed to the working position and hold it therein in a pressed-in manner.

The inventive principle has proven particularly advantageous on a packaging machine that may be a chamber belt machine. Preferably, this may be a chamber belt machine, the sealing station of which may be equipped with two sealing rails and enables a loading operation on both sides. Other aspects and advantages of the present invention will be apparent from the following detailed description of the preferred embodiments and the accompanying drawing figures.

DESCRIPTION OF THE SEVERAL VIEWS OF THE DRAWINGS

In the following, an advantageous embodiment of the present invention will be explained in more detail making reference to a drawing, in which the individual figures show.

DETAILED DESCRIPTION OF THE INVENTION

Figure 1:
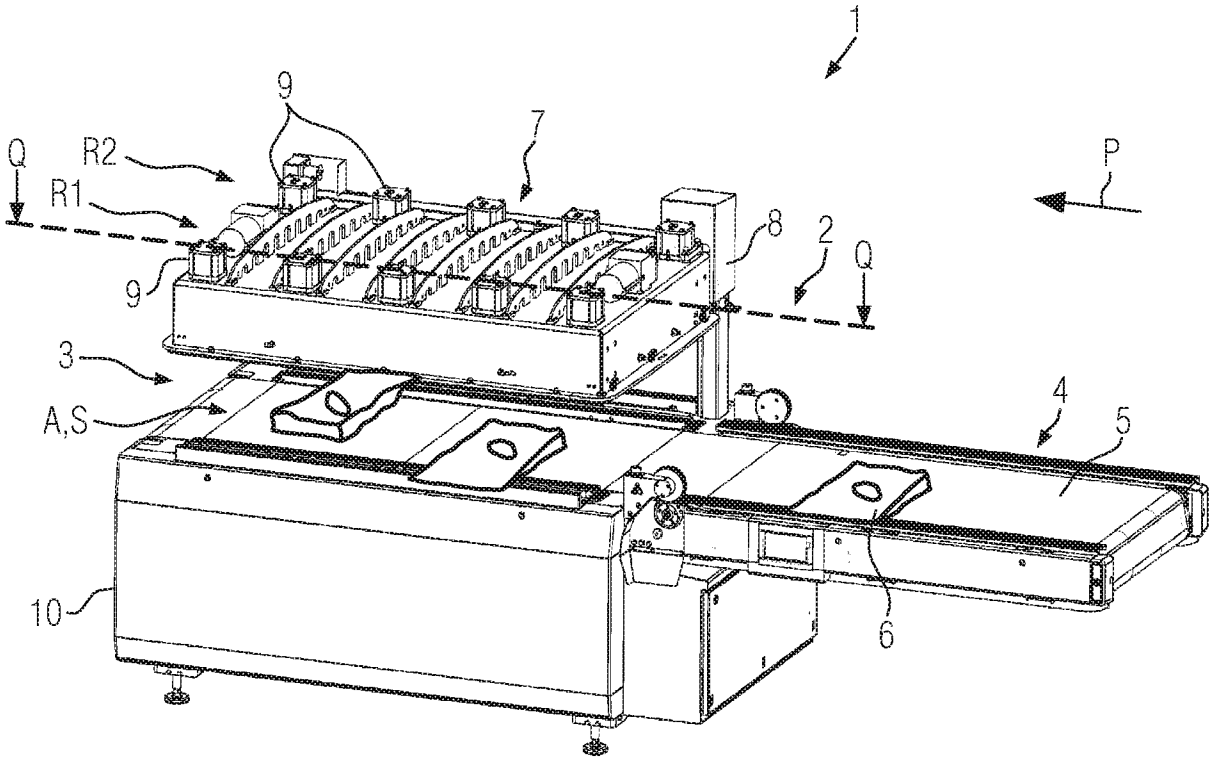
FIG. 1 is a perspective view of one embodiment of a packaging machine in accordance with the teachings of the present disclosure, wherein the packaging machine is in the form of a chamber belt machine.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a packaging machine 1 which is configured as a chamber belt machine 2. Chamber belt machine 2 comprises a sealing station 3 for a sealing process S and a transport device 4 for a loading process of sealing station 3. Chamber belt machine 2 shown in FIG. 1 is configured for a two-sided loading process. Viewed in transport direction P, products 6 are supplied to sealing station 2 on a conveyor belt 5 of transport device 4 for a work process A, in particular for a sealing process S.

In FIG. 1, sealing station 3 comprises a cover 7 which is mounted vertically adjustable relative to a machine frame 10 of packaging machine 1 by use of a drive 8. Positioned in a first row R1 and in a second row R2 on cover 7 are five pneumatic units 9, each strung together in production direction P. Respective pneumatic units 9 arranged in groups of five are adapted to move working components 14 respective arranged within cover 7, in particular sealing rails 15 which are positioned on two sides within cover 7 (see FIG. 2).

Figure 2:
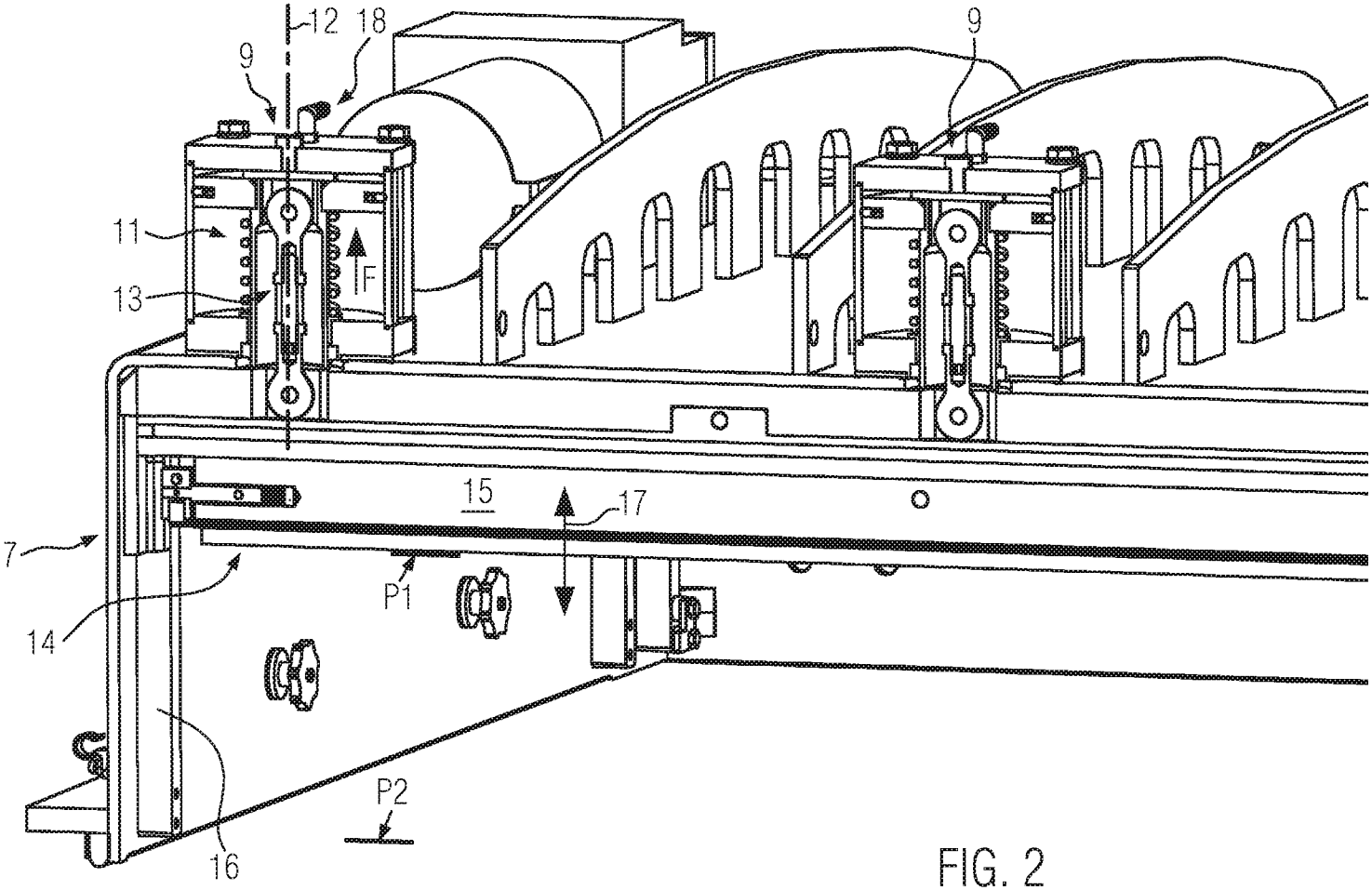
FIG. 2 is an enlarged perspective section view of the packaging machine of FIG. 1 cut along the line Q-Q in the region of the cover of the packaging machine.

FIG. 2 shows two pneumatic units 9 with a compensating function in a perspective sectional view along the section line Q-Q according to FIG. 1. The inventive principle is described below with reference to one of the pneumatic units 9 attached to cover 7.

For the compensating function, pneumatic unit 9 comprises a piston 11 which is mounted within the pneumatic unit 9 linearly adjustable along an axis 12. Piston 11 is configured to be hollow in such a way that a coupling member 13 that is mounted tiltable relative to axis 12 is received therein at least in part. Pneumatic unit 9 is connected via coupling member 13 to a working component 14 arranged in cover 7 of sealing station 3.

According to FIG. 2, working component 14 is formed within sealing station 3 as sealing rail 15. Sealing rail 15 forms a tool for sealing products 6 supplied to sealing station 3. Sealing rail 15 is mounted to be adjustable between a first position P1 and a second position P2 by way of a lifting motion 17 using pneumatic unit 9. In first position P1, it is positioned raised upwardly within cover 7. In second position P2, sealing rail 15 is positioned in a sealing position, in which it seals products 6 at a predetermined sealing height that are supplied to sealing station 3.

Furthermore, FIG. 2 shows that pneumatic unit 9 comprises a compressed air connection 18 via which compressed air is delivered to the interior of pneumatic unit 9 for linear adjustment of piston 11 in order to force piston 11 downwardly. Sealing rail 15 can therewith be moved by the piston motion and coupling member 13 attached between piston 11 and the sealing rail to the sealing position.

By way of a spring 19 disposed within pneumatic unit 9 on the circumference of piston 11, a restoring force F acts upon piston 11, forced downwardly due to compressed air, in order to move piston 11 to its upper initial position, in which sealing rail 15 is arranged in first position P1. Furthermore, FIG. 2 shows that sealing rail 15 is mounted to be adjustable along a guide 16 between first position P1 and second position P2.

The features described in connection with pneumatic unit 9 according to FIG. 2 also apply to the other pneumatic units 9 arranged on cover 7.

Figure 3:
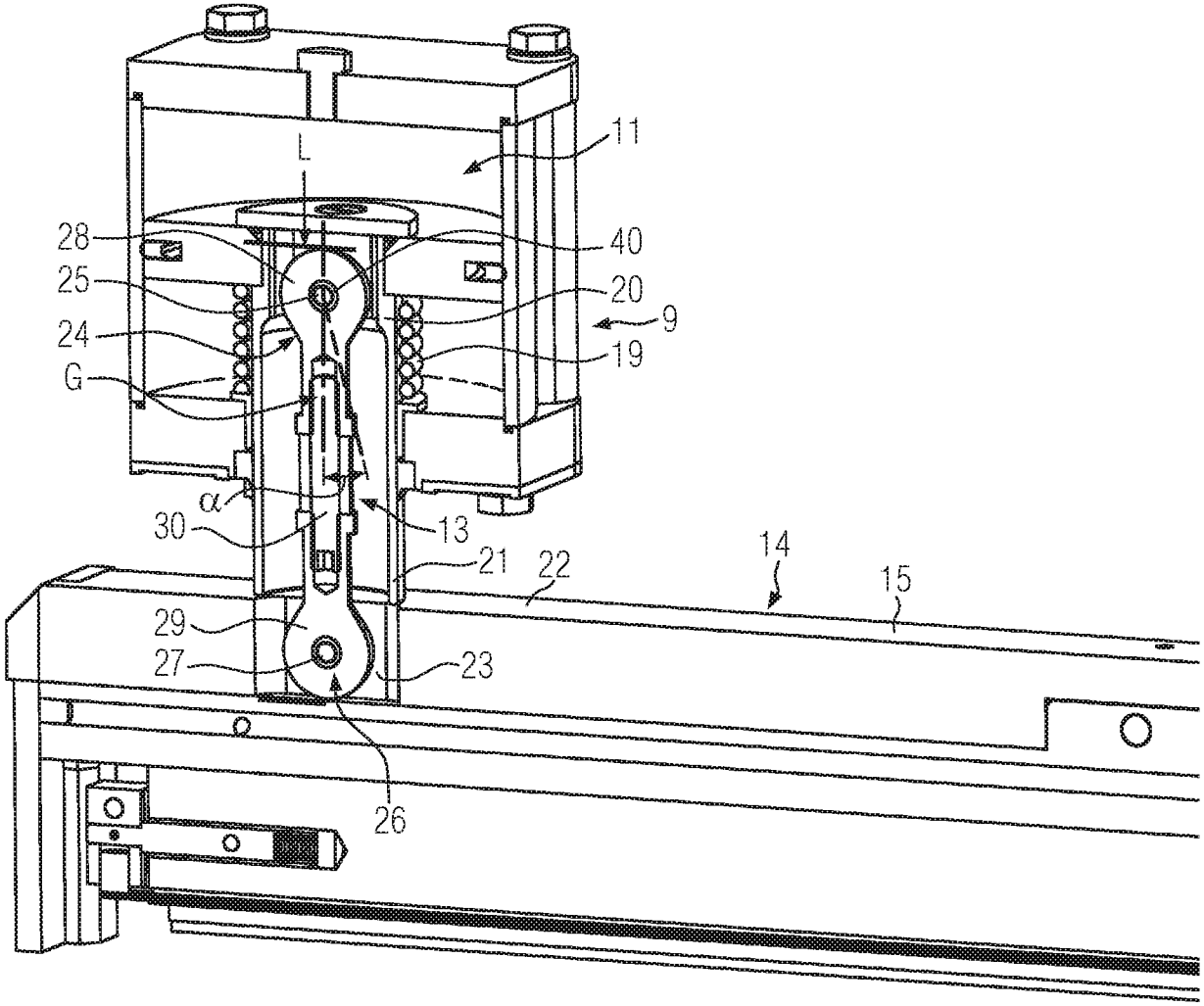
FIG. 3 is a further enlarged perspective view of FIG. 2 that further illustrates the compensating function employed with respect to the coupling member according to the present disclosure.

FIG. 3 shows an enlarged sectional view of pneumatic unit 9 used with packaging machine 1 according to the invention, in particular with chamber belt machine 2 shown in FIG. 1.

FIG. 3 illustrates the connection between pneumatic unit 9 and sealing rail 15 without cover 7 of sealing station 3. FIG. 3 shows that piston 11 comprises a piston rod 20 which is formed to be hollow. Coupling member 13 is almost completely received within hollow piston rod 20.

FIG. 3 also shows that piston 11 of pneumatic unit 9 is seated with its lower end 21 on a surface 22 formed on working component 14, but is not rigidly attached thereto. Once coupling member 13 is deflected by a deflection angle $\alpha$ shown by way of example in FIG. 3 from its vertical equilibrium position G, lower end 21 of piston 11 can therefore escape along surface 22, so that no distortion arises between piston 11 and sealing rail 15.

Coupling member 13 protrudes beyond the contact area between lower end 21 of piston 11 and surface 22 into a receptacle 23, formed on sealing rail 15, in which it is movably attached. FIG. 3 also shows that a first end 24 of coupling member 13 within hollow piston rod 20 is movably mounted by way of a first pin 25 and a second end 26 of coupling member 13 within receptacle 24 of sealing rail 15 by way of a second pin 27.

First end 24 of coupling member 13 comprises a first joint 28 with which it is attached in an articulated manner within piston 11. Second end 26 of coupling member 13 comprises a second joint 29 with which coupling member 13 is attached in an articulated manner to sealing rail 15 within its receptacle 23.

According to FIG. 3, coupling member 13 comprises between first end 24 and second end 26 a connector pin 30 for obtaining a predetermined longitudinal extension L of coupling member 13. Connector pin 30 is formed having a thread at its respective ends to which the respective ends 24, 26 of coupling member 13 are screwed. Connector pin 30 can be formed having different lengths with respect to a predetermined sealing height.

Figure 4:
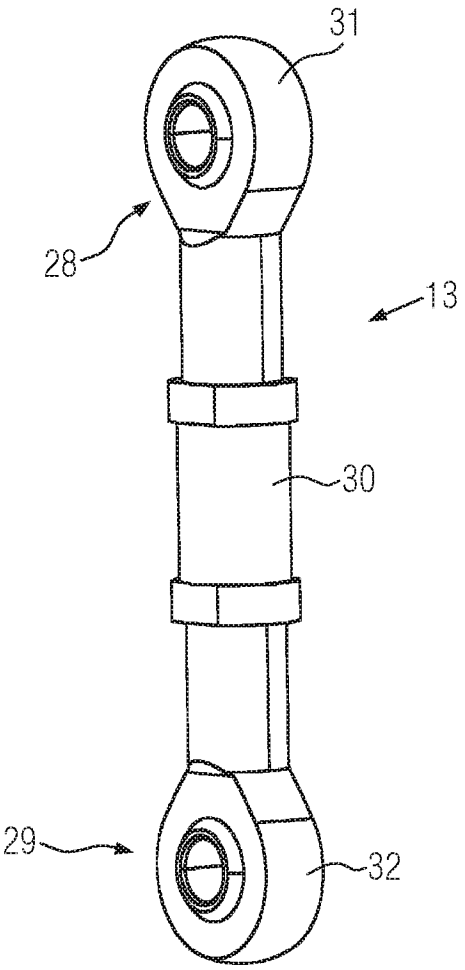
FIG. 4 shows an isolated view of the embodiment of a coupling member of a pneumatic unit of a packaging machine in accordance with the teachings of the present disclosure.

FIG. 4 shows coupling element 13 in an isolated view. First joint 28 comprises a first ball joint 31 and second joint 29 a second ball joint 32. The respective ball joints 31, 32 allow for coupling member 13 to be mounted within piston 11 to be rotatable triaxially about its suspension point 40 (see FIG. 3) relative to axis 12. Piston 11 guided linearly on pneumatic unit 9 can therewith be connected via coupling member 13 to working component 14, i.e. sealing rail 15, such that no static distortions or jamming between pneumatic unit 9 and working component 14 occur during lifting motion 17.

The principle according to the invention has been described on the basis of a working component 14 in the form of a sealing rail 15 which is attached to pneumatic unit 9. Nevertheless, the principle according to the invention can also be applied to other adjustably mounted working components. It would also be conceivable, for example, to adjustably mount an adjustably mounted cutting device based on the principle according to the invention.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A packaging machine comprising:

a machine frame;

a working component capable of carrying out a work process, the working component being adjustably mounted on the machine frame and disposed for movement relative to the machine frame between a first position and a second position;

a pneumatic unit for moving the working component between the first position and the second position, the pneumatic unit including a piston; and a coupling member mounted on the pneumatic unit, the coupling member being tiltable relative to an axis and linearly adjustable along the axis, and the coupling member connecting the pneumatic unit to the working component, wherein the coupling member is arranged at least in part within the piston of the pneumatic unit, and wherein the piston comprises a piston rod that is at least in part formed to be hollow and within which the coupling member is attached in an articulated manner.

2. The packaging machine according to claim 1, wherein the coupling member is mounted rotatable triaxially relative to the axis within the piston.

3. The packaging machine according to claim 1, wherein the coupling member has a first end comprising a first joint that attaches the coupling member to the piston in an articulated manner, and the coupling member has a second end having a second joint that connects the coupling member to the working component in an articulated manner.

4. The packaging machine according to claim 3, wherein the first joint and the second joint are each one of a pivot or a ball joint.

5. The packaging machine according to claim 1, wherein the coupling member is mounted tiltably within the piston and to the piston by a first pin that is orientated perpendicular to the axis.

6. The packaging machine according to claim 1, wherein the coupling member comprises a first portion and a connector pin attached to the first portion in an exchangeable manner in order to obtain a predetermined longitudinal extension of the coupling member.

7. The packaging machine according to claim 1, further comprising a sealing station, wherein the working component is a sealing rail adjustably connected to the sealing station.

8. The packaging machine according to claim 7, wherein the sealing station comprises a cover, the pneumatic unit is disposed on the cover, and the coupling member is connected to the sealing rail positioned within the cover.

9. The packaging machine according to claim 1, wherein the packaging machine is a chamber belt machine.

10. The packaging machine according to claim 1, further comprising at least one additional pneumatic unit operably connected to the working component, wherein the pneumatic unit and the at least one additional pneumatic unit are operable to execute a lifting motion of the working component, and wherein the working component is mounted for movement guided by at least one guide member.

11. The packaging machine according to claim 10, wherein the at least one additional pneumatic unit comprises at least three additional pneumatic units.

12. The packaging machine according to claim 1, wherein the coupling member comprises first and second portions and a connector pin attached to the first and second portions in an exchangeable manner in order to obtain a predetermined longitudinal extension of the coupling member.

13. The packaging machine according to claim 12, wherein the first and second portions of the coupling member comprise first and second ends, respectively, of the coupling member.

14. A packaging machine comprising:

a machine frame;

a working component capable of carrying out a work process, the working component being adjustably mounted on the machine frame and disposed for movement relative to the machine frame between a first position and a second position;

a pneumatic unit for moving the working component between the first position and the second position, the pneumatic unit including a piston; and a coupling member mounted on the pneumatic unit, the coupling member being tiltable relative to an axis and linearly adjustable along the axis, and the coupling member connecting the pneumatic unit to the working component, wherein the coupling member is arranged at least in part within the piston of the pneumatic unit, and wherein the coupling member comprises a first portion and a connector pin attached to the first portion in an exchangeable manner in order to obtain a predetermined longitudinal extension of the coupling member.

15. The packaging machine according to claim 14, wherein the coupling member further comprises a second portion, and wherein the connector pin is also attached to the second portion in an exchangeable manner.

16. The packaging machine according to claim 15, wherein the first and second portions of the coupling member comprise first and second ends, respectively, of the coupling member.

* * * * *